US010718558B2

(12) United States Patent
Berchowitz et al.

(10) Patent No.: US 10,718,558 B2
(45) Date of Patent: Jul. 21, 2020

(54) INDEPENDENT AUXILIARY THERMOSIPHON FOR INEXPENSIVELY EXTENDING ACTIVE COOLING TO ADDITIONAL FREEZER INTERIOR WALLS

(71) Applicant: Global Cooling, Inc., Athens, OH (US)

(72) Inventors: David M. Berchowitz, Athens, OH (US); Todd Richards, Athens, OH (US)

(73) Assignee: Global Cooling, Inc., Athens, OH (US)

( * ) Notice: Subject to any disclaimer, the term of this patent is extended or adjusted under 35 U.S.C. 154(b) by 64 days.

(21) Appl. No.: 15/837,504

(22) Filed: Dec. 11, 2017

(65) Prior Publication Data

US 2019/0178558 A1 Jun. 13, 2019

(51) Int. Cl.
*F25D 16/00* (2006.01)
*F25D 17/02* (2006.01)
(Continued)

(52) U.S. Cl.
CPC ..... *F25D 16/00* (2013.01); *F25B 7/00* (2013.01); *F25B 25/005* (2013.01);
(Continued)

(58) Field of Classification Search
CPC ..... F25D 16/00; F25D 17/02; F25D 23/061; F25D 23/068; F25D 11/022;
(Continued)

(56) References Cited

U.S. PATENT DOCUMENTS 2,491,105 A * 12/1949 Gaugler ..... F25D 11/025 62/175
3,866,429 A * 2/1975 Blomberg ..... F25B 15/10 62/65

(Continued)

FOREIGN PATENT DOCUMENTS

DE 102009045900 A1 * 4/2011 ..... F25D 23/061
GB 636618 A * 5/1950 ..... F25D 11/025

(Continued)

*Primary Examiner* — Len Tran
*Assistant Examiner* — Jenna M Hopkins
(74) *Attorney, Agent, or Firm* — Frank H. Foster; Kremblas & Foster

(57) ABSTRACT

An auxiliary thermosiphon has an auxiliary refrigerant conduit with an auxiliary evaporation segment in thermally conductive connection to an interior wall of the freezer. The auxiliary refrigerant conduit contains an auxiliary refrigerant that is isolated from the primary refrigerant of the primary cooling apparatus. The auxiliary refrigerant conduit also extends upward to an auxiliary condensation segment of the auxiliary refrigerant conduit at an elevation above the auxiliary evaporation segment. A thermal bridge is in physical thermal contact with the auxiliary condensation segment and in physical thermal contact with a portion of a primary evaporation segment of the primary refrigeration apparatus. Heat is transported through the thermal bridge from the auxiliary thermosiphon to the primary refrigerant conduit and consequently to the primary refrigeration apparatus for removal from the freezer.

7 Claims, 3 Drawing Sheets

(51) Int. Cl.

| | |
|---|---|
| ***F25D 11/02*** | (2006.01) |
| ***F28F 1/00*** | (2006.01) |
| ***F25D 19/00*** | (2006.01) |
| ***F25D 23/06*** | (2006.01) |
| ***F25B 25/00*** | (2006.01) |
| ***F25B 7/00*** | (2006.01) |

(52) U.S. Cl.
CPC ..... *F25D 11/022* (2013.01); *F25D 11/025* (2013.01); *F25D 17/02* (2013.01); *F25D 19/00* (2013.01); *F25D 23/061* (2013.01); *F25D 23/068* (2013.01); *F28F 1/00* (2013.01)

(58) Field of Classification Search
CPC .. F25D 11/025; F25D 23/063; F28D 15/0275; F25B 25/002; F25B 25/005
USPC ..... 62/334, 447
See application file for complete search history.

(56) References Cited

U.S. PATENT DOCUMENTS 4,067,628 A 1/1978 Sherbum
4,383,421 A * 5/1983 Quesnoit ..... F25B 5/04 62/333
4,485,639 A 12/1984 Sakamoto
4,918,936 A 4/1990 Sakamoto
4,949,554 A * 8/1990 Branz ..... A47F 3/0404 62/248
4,951,481 A * 8/1990 Negishi ..... F25D 3/06 62/406
5,228,308 A * 7/1993 Day ..... F25B 5/04 62/198
5,406,805 A 4/1995 Radermacher et al.
5,816,063 A * 10/1998 Schulak ..... F25D 16/00 62/238.6
5,964,101 A * 10/1999 Schulak ..... F24D 11/0214 62/430
6,442,959 B1 9/2002 Sone
6,550,255 B2 4/2003 Rudick et al.
6,578,629 B1 * 6/2003 Trent ..... F24F 1/0059 165/104.13
6,725,907 B2 * 4/2004 Sone ..... F25B 25/005 165/104.11
6,804,965 B2 * 10/2004 Abras ..... F25B 21/02 165/156
7,222,662 B2 5/2007 Neumann
7,694,717 B2 * 4/2010 Bonner ..... F28D 7/0008 165/164
7,861,768 B1 * 1/2011 Ghantiwala ..... F28D 15/0275 165/104.21
9,239,182 B2 1/2016 Lee et al.
9,523,522 B2 * 12/2016 Chou ..... F25B 39/028
2005/0109057 A1 * 5/2005 Sone ..... F25B 23/006 62/434
2008/0035310 A1 * 2/2008 Hsu ..... F28D 15/0275 165/104.21
2009/0260793 A1 * 10/2009 Wang ..... B23P 15/26 165/181
2009/0310307 A1 * 12/2009 Lin ..... G06F 1/203 361/700
2010/0043463 A1 2/2010 Fleming et al.
2010/0154466 A1 * 6/2010 Tindale ..... F25D 11/025 62/476
2012/0042872 A1 * 2/2012 McEntee ..... F24S 10/45 126/652
2013/0160476 A1 * 6/2013 Lee ..... F25D 11/02 62/291
2013/0167582 A1 * 7/2013 Jones ..... F25B 41/067 62/515
2015/0027148 A1 * 1/2015 Chung ..... F25D 11/022 62/89
2015/0233617 A1 * 8/2015 Chou ..... F25B 39/028 62/190
2016/0061532 A1 * 3/2016 Espersen ..... F28D 15/0266 165/104.21
2017/0292776 A1 10/2017 Kim et al.
2017/0343266 A1 * 11/2017 Liengaard ..... F25B 23/006
2019/0090385 A1 * 3/2019 Machida ..... H05K 7/20336

FOREIGN PATENT DOCUMENTS

JP 19990201083 7/1999
JP 20150222085 11/2015
WO WO-2009157318 A1 * 12/2009 ..... F25D 11/025
WO WO-2010001643 A1 * 1/2010 ..... F25D 11/025
WO WO-2010024080 A1 * 3/2010 ..... F25B 25/005
WO WO-2016095587 A1 * 6/2016 ..... F25D 19/00
WO WO-2016095589 A1 * 6/2016 ..... F25D 11/00
WO WO-2016095590 A1 * 6/2016 ..... F25D 16/00

* cited by examiner

Fig. 1
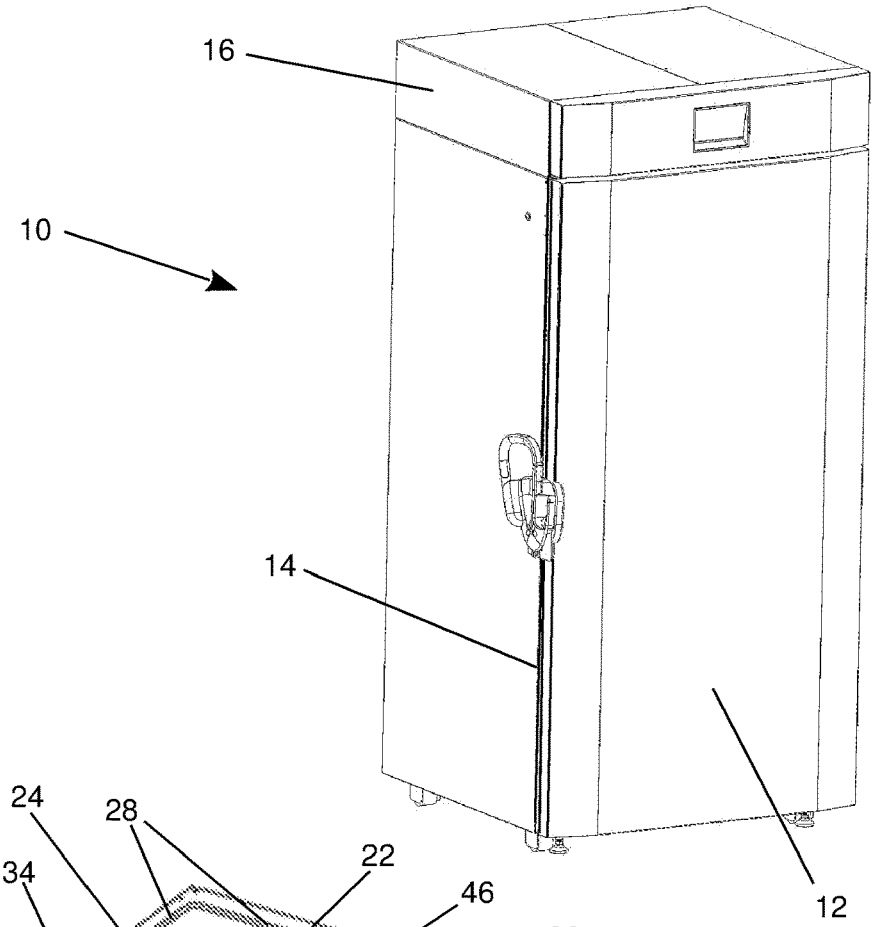
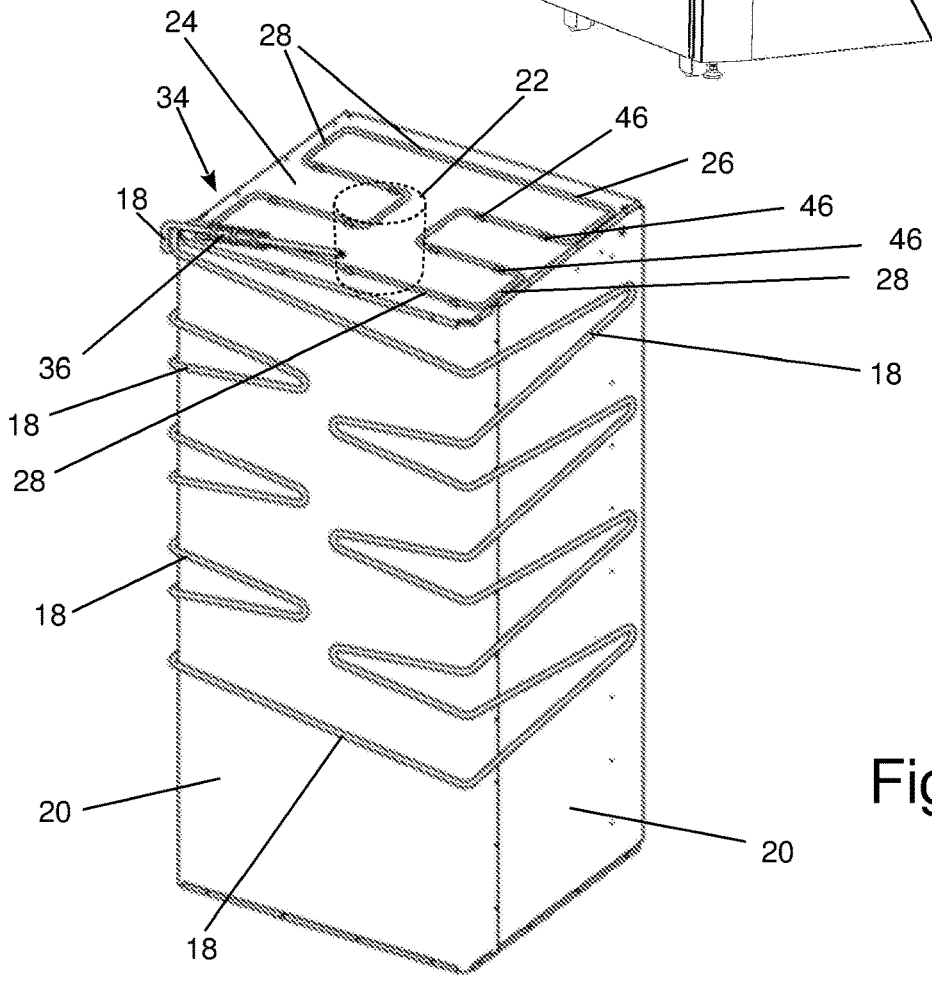
Fig. 2

Fig. 3
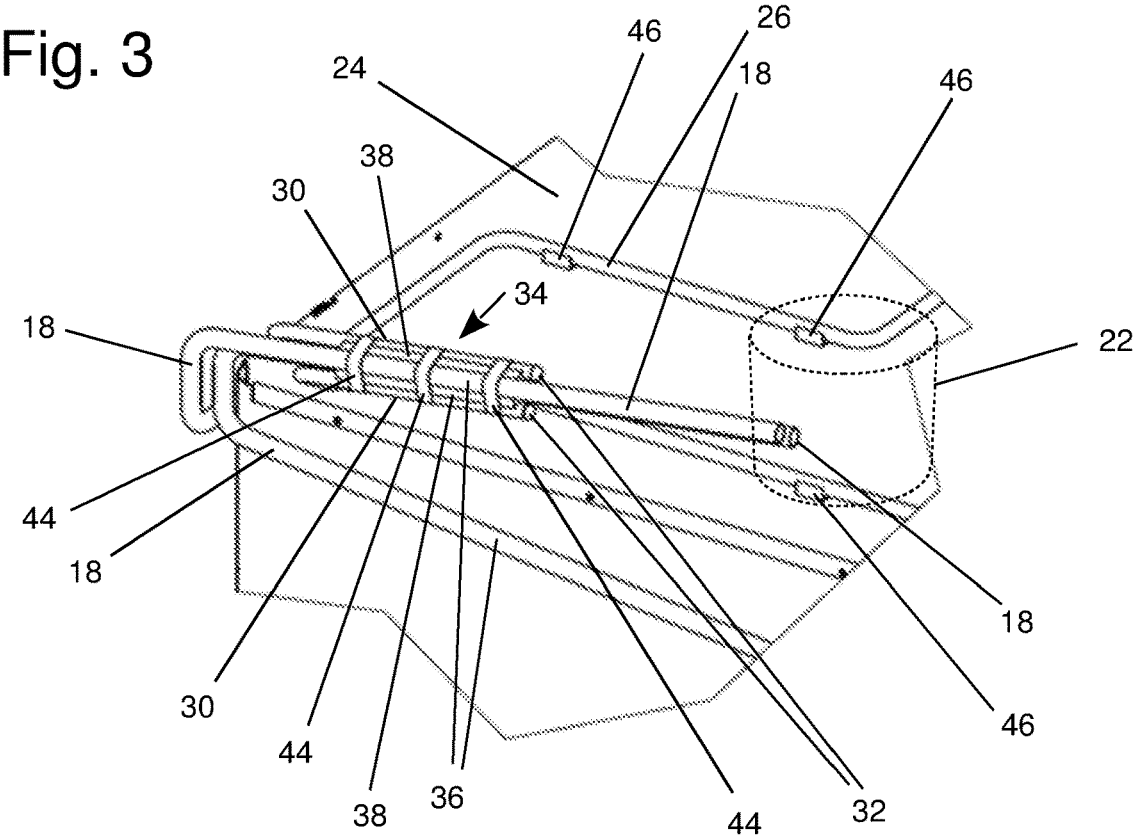
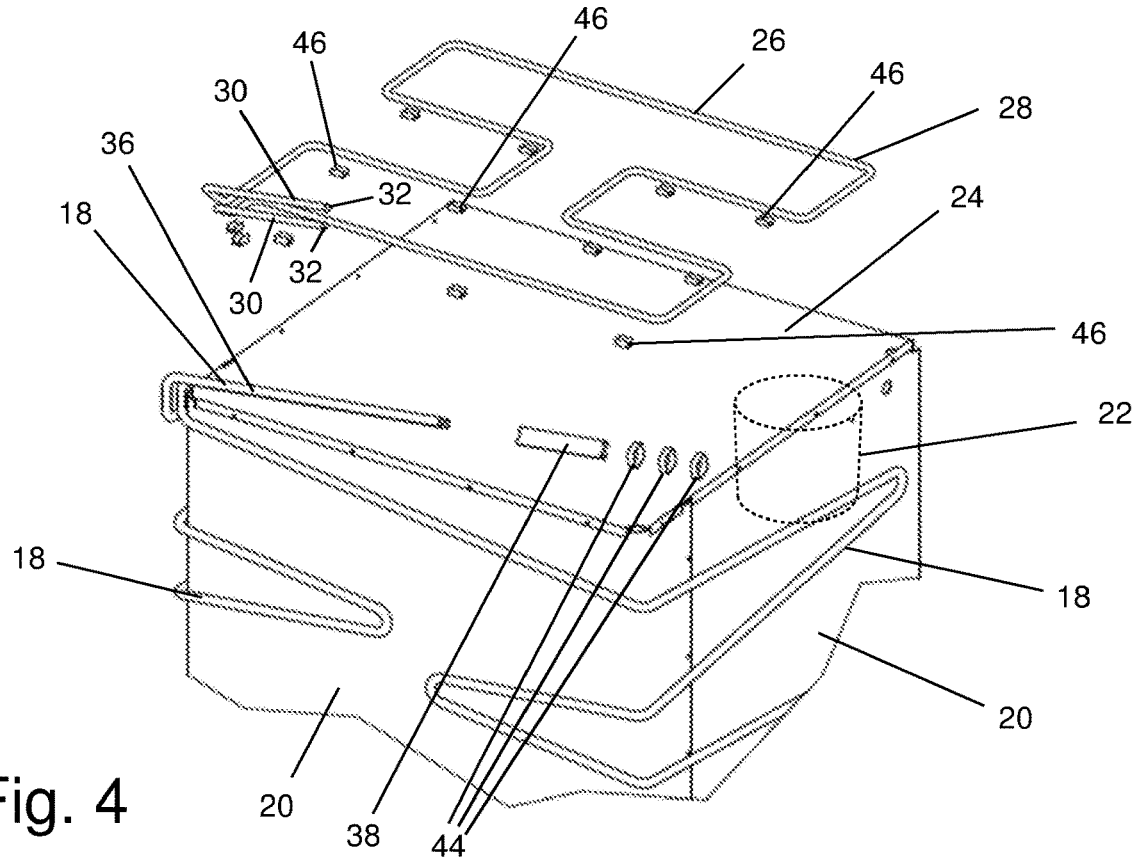
Fig. 4

Fig. 7
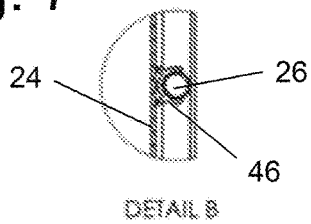
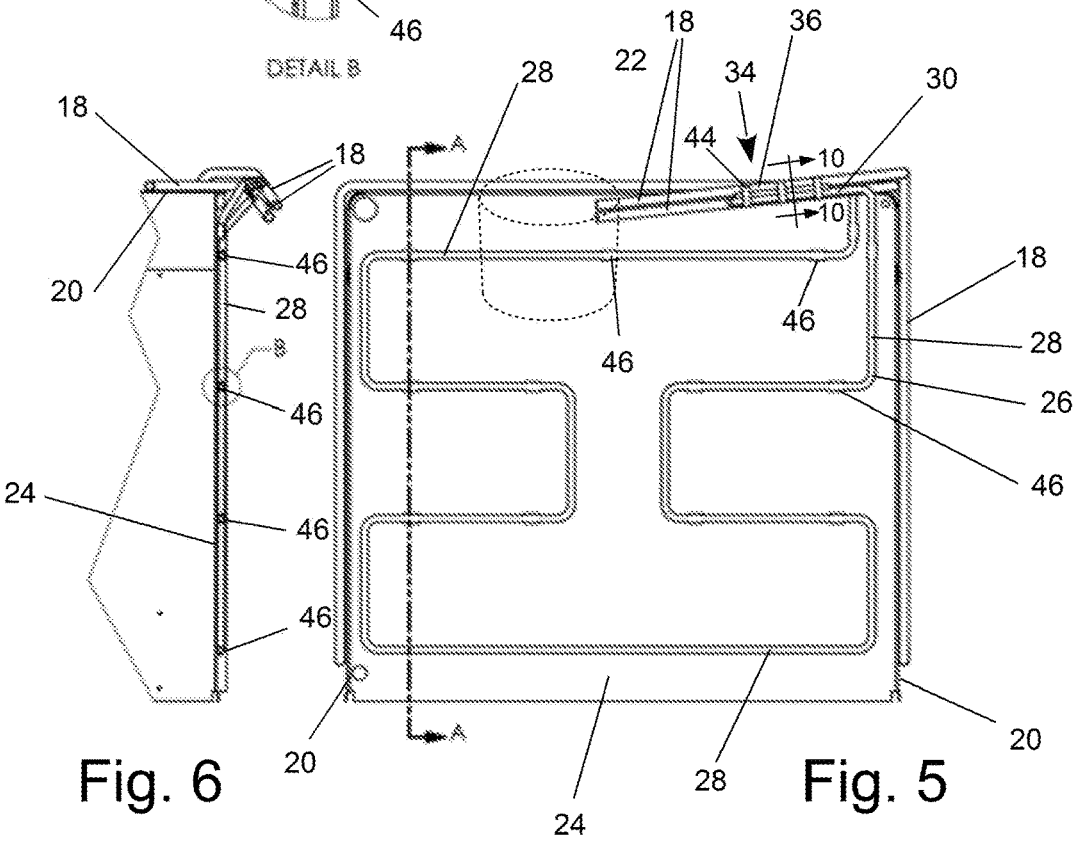
Fig. 6
Fig. 5
Fig. 8
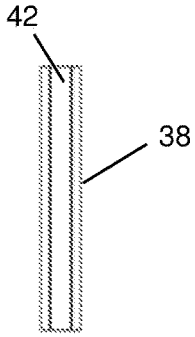
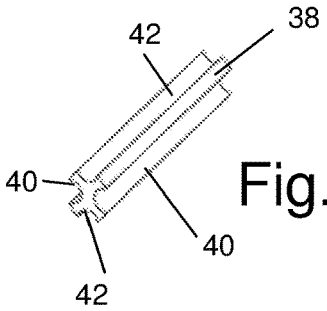
Fig. 9
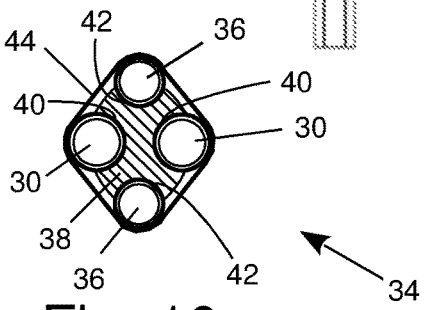
Fig. 10
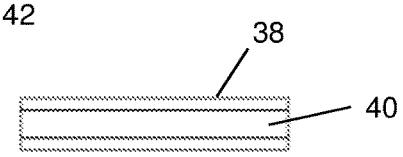
Fig. 11

INDEPENDENT AUXILIARY THERMOSIPHON FOR INEXPENSIVELY EXTENDING ACTIVE COOLING TO ADDITIONAL FREEZER INTERIOR WALLS

CROSS-REFERENCES TO RELATED APPLICATIONS (Not Applicable)

STATEMENT REGARDING FEDERALLY-SPONSORED RESEARCH AND DEVELOPMENT (Not Applicable)

THE NAMES OF THE PARTIES TO A JOINT RESEARCH AGREEMENT (Not Applicable)

REFERENCE TO AN APPENDIX (Not Applicable)

BACKGROUND OF THE INVENTION

This invention relates generally to refrigeration or cooling apparatus for freezers of the type in which a cold space is cooled by removing heat from the interior freezer cabinet walls and more particularly relates to low cost improvements in the temperature distribution in cooled wall freezers, especially ultra-low temperature freezers. The improved temperature distribution is accomplished by inexpensively extending the interior wall surfaces that are actively cooled to areas not cooled directly by the primary cooling apparatus. Improving the temperature distribution results in more reliable and uniform cooling of the contents as well as reduced operating costs. The invention is applicable to both conventional compression Rankine cycle refrigeration systems and Stirling cycle cooler or cryocooler systems.

FIGS. 1 through 6 illustrate an ultra-low temperature (ULT) freezer that combines structures known in the prior art with the structures of the invention. As known in the prior art, a ULT freezer typically has a vacuum insulated cabinet 10 closed off by a vacuum insulated door 12. A double or triple gasket 14 that is attached to the door 12 provides sealing against heat and moisture from the surrounding environment.

Typically a freezer is cooled by the combination of a cooling apparatus that is a cooler connected to a refrigerant circuit. The cooler is a mechanical refrigeration machine that removes heat from and condenses a refrigerant. The cooler is connected to a refrigerant circuit that has a refrigerant conduit containing a refrigerant that transports heat from in or around the interior cooled space to the cooler. The term "conduit" is used in this description to refer to a refrigerant conduit that is part of the refrigerant circuit that conveys refrigerant through its internal passage. The conduit in a refrigerant circuit is usually principally a metal tube because of the high pressure of the refrigerant. However the refrigerant conduit can include other refrigerant passages including passages formed in the cooler, as well as in fittings, manifolds or through a metal plate, such as the passages in a metal sheet that surrounds the freezer compartment of a conventional domestic refrigerator. Evaporative refrigeration equipment have a refrigerant conduit which includes both an evaporation segment in which the refrigerant accepts heat by evaporating and a condensation segment in which the refrigerant rejects heat by being cooled and condensed.

The cooler 22 that is used with the present invention is mounted in a top compartment 16 of the cabinet 10 but some types of coolers can be located at the bottom of the freezer. The present invention operates in association with a cooler 22 that is known in the prior art and therefore is illustrated symbolically. For example, the cooler 22 can be a Stirling cycle cooler or cryocooler, which is preferred, or a conventional compression Rankine cycle refrigeration system using a compressor and heat exchanger/condenser.

The invention is used in combination with a primary refrigerant circuit of a type known in the prior art. The primary refrigerant circuit has a continuous refrigerant conduit 18 which is integrated into or thermally attached to the interior vertical side walls 20 of the freezer cabinet 10 for directly cooling those walls 20. Since the interior walls 20 are exposed to the inside air of the freezer and intercept the heat from outside the freezer, the interior space adjacent the walls 20 will take on the temperature of the walls 20. The opposite ends of the refrigerant conduit 18 are connected to a cooler 22 that is diagrammatically shown in FIGS. 2-5.

For reasons that will become apparent, the cooling apparatus that is described above and known in the prior art will subsequently be referred to as the primary cooling apparatus and its principal components as the primary cooler 22 and the primary refrigerant conduit 18.

Although prior art freezers of the type described have operated successfully, they have a problem that would be desirable to eliminate. Practical considerations in the fabrication of a refrigerant conduit that is thermally attached to cabinet interior walls limit the area of the interior walls that are actively cooled by the primary cooling apparatus. Often the top cabinet wall 24 and the bottom cabinet wall (not visible) of the interior space as well as the inner wall of the door 12 are not cooled because primary refrigerant conduit is not run across and in thermal contact with the top cabinet wall 24, the bottom cabinet wall or the inner wall of the door 12. The reason is the difficulty of bending the tubular conduit into the necessary configuration. Ordinarily the entire primary refrigeration conduit is bent and shaped prior to its attachment to the outer surfaces of the interior cabinet walls. The primary refrigerant conduit 18 requires a continuous slope downward from its top to avoid low spots or traps which can cause vapor lock. Such a trap is a conduit segment that is slightly lower than its surrounding opposite ends which can allow liquid refrigerant to accumulate in the trap. The accumulated liquid prevents the vapor phase from moving through the trap which can destroy the performance of the primary cooling apparatus. Of course it would be technically possible to bend a tubular primary refrigerant conduit around a corner between a side wall and the top or bottom wall in order to extend the refrigerant conduit over the top or bottom walls. It would also be technically possible to form such a primary refrigerant conduit with the required slope to avoid low spots or traps. But such a fabrication process would add greatly to the cost because of the difficulty of bending the tubular conduits in a way that does not form flow restrictions, low spots or traps.

One consequence of having some of the cabinet wall area not actively cooled by the primary cooling apparatus is poor temperature distribution within the cold space. The poor temperature distribution results in temperature stratification within the cooled air in the freezer because there is typically no forced convection in freezers in which the interior walls are cooled by the cooling apparatus. The heat that enters the cooled interior cabinet space through these uncooled surfaces must be removed by the actively cooled walls. This causes temperature gradients and stratification within the freezer resulting in warmer areas that may compromise a specimen or product that is stored within the freezer. The warmer region within the freezer cabinet is typically near the top because of the cumulative effect of convection in the cooled interior cabinet space and the absence of active cooling of the interior, top cabinet wall. However, the cumulative effect of an interior cabinet space that is so densely packed that convection is retarded combined with an absence of active cooling of the interior bottom cabinet wall can result in a warmer region near the interior bottom. An ideal freezer would be one that has no temperature gradients or stratification within the interior space so that a desired interior temperature displayed by instrumentation would accurately represent the temperature of the entire contents of the freezer.

Another problem also exists as a consequence of spatial variations of the temperature in the cooled space within the freezer cabinet. The cooling apparatus must cool to at least the lowest temperature within the cooled space. If an operator of a freezer recognizes the existence of the undesirable temperature distribution described above and attempts to compensate for that problem by reducing the set point temperature of the freezer's control system, the energy consumed by operation of the freezer and its cost would be increased. If an invention can reduce the spatial temperature distribution in the freezer, the cost of operating the freezer would be reduced. The cost would be reduced not only because there would be less or no need to compensate for the problematic spatial temperature distribution but also because the lowest temperature within the freezer would be raised and the highest temperature would be lowered. The rise in the lowest temperature would mean that the primary cooling apparatus would require less energy for operating.

It is therefore an object and purpose of the invention to simplify construction of a freezer in a manner that reduces the cost of fabricating a cooled wall freezer by extending active cooling to the top and/or bottom interior walls without requiring the primary refrigerant conduit to be bent in a configuration for attachment to both the side walls and also the top and/or bottom walls of the freezer's interior cabinet walls.

It is a further object and purpose of the invention to reduce the energy cost for operating a freezer by substantially reducing or eliminating spatial variations of the temperature distribution within the freezer.

BRIEF SUMMARY OF THE INVENTION

The invention adds an independent auxiliary thermosiphon that is thermally connected to the primary cooling apparatus by a thermal bridge in order to provide active cooling to parts of the interior of the freezer that are not directly cooled by the primary cooling apparatus. This thermally extends the cooling function of the primary cooling apparatus to an additional interior wall of a freezer cabinet by means of the auxiliary thermosiphon without extending the primary refrigerant conduit to that additional interior wall. The refrigerant of the auxiliary thermosiphon and the refrigerant of the primary cooling apparatus circulate in entirely separate independent fluid circuits. The auxiliary thermosiphon is not connected to a pump or compressor. An evaporation segment of the primary refrigerant conduit is connected to an auxiliary refrigerant conduit of the auxiliary thermosiphon by the thermal bridge between the respective refrigerant conduits. The thermal bridge is solely a mechanical connection that may be installed after the primary refrigerant conduit is installed on the walls of the liner. The thermal bridge is located at a higher elevation part of the auxiliary thermosiphon and the auxiliary refrigerant conduit extends down from the thermal bridge into thermal connection to an interior wall of the cabinet. Consequently, heat is transferred through the thermal bridge from the auxiliary thermosiphon to the primary cooling apparatus.

More specifically, the auxiliary thermosiphon of the invention has an auxiliary refrigerant conduit having an auxiliary evaporation segment in thermally conductive connection to an interior wall of the freezer. The auxiliary thermosipnon contains an auxiliary refrigerant that is isolated from the primary refrigerant. The auxiliary refrigerant conduit also extends upward to an auxiliary condensation segment of the auxiliary refrigerant conduit at an elevation above the auxiliary evaporation segment. A thermal bridge is in physical thermal contact with the auxiliary condensation segment and in physical thermal contact with a portion of the primary evaporation segment for transporting heat through the thermal bridge from the auxiliary thermosiphon to the primary refrigerant conduit.

BRIEF DESCRIPTION OF THE SEVERAL VIEWS OF THE DRAWINGS

FIG. 1 is a view in perspective of the exterior of a typical ultra-low temperature freezer embodying the present invention.

FIG. 2 is a view in perspective of the ultra-low temperature freezer of FIG. 1 but with the exterior housing and adjacent insulation removed to reveal the interior walls, which form the interior liner of its cabinet and also revealing the primary cooling apparatus and the auxiliary thermosiphon of the invention.

FIG. 3 is an enlarged view of a portion of the structures illustrated in FIG. 2 showing more detail of the thermal bridge that connects the primary cooling apparatus to the auxiliary thermosiphon of the invention.

FIG. 4 is an exploded view of the structures illustrated in FIG. 2.

FIG. 5 is a top plan view of the embodiment illustrated in FIGS. 1-4.

FIG. 6 is a view in section taken along the line A-A in FIG. 5.

FIG. 7 is an enlarged view in section taken along the line A-A in FIG. 5 showing a segment of the embodiment illustrated as in FIGS. 2-6 and showing in detail the mounting brackets used to thermally connect the auxiliary thermosiphon to a horizontal interior wall of the freezer cabinet in a manner to maintain the thermosiphon in a properly inclined orientation.

FIG. 8 is a top plan view of the central thermal conductor of the thermal bridge of the invention.

FIG. 9 is a view in perspective of the central thermal conductor of the thermal bridge of the invention.

FIG. 10 is an enlarged view in section taken along the line 10-10 of FIG. 5 showing the assembled thermal bridge of the invention.

FIG. 11 is a side view of the central thermal conductor of the thermal bridge of the invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose.

DETAILED DESCRIPTION OF THE INVENTION

Referring principally to FIGS. 2 through 6, the invention has an auxiliary thermosiphon formed by an auxiliary refrigerant conduit 26 that contains an auxiliary refrigerant. The auxiliary refrigerant conduit 26 has an auxiliary evaporation segment 28 that is mounted in a distributed, thermally conductive connection to a freezer cabinet interior wall 24 that is not in thermal connection to the primary refrigerant conduit 18. As illustrated, the auxiliary evaporation segment 28 is thermally connected to the top inner cabinet wall 24. For a typical ULT freezer, the interior wall to which a thermosiphon is thermally connected may include the interior bottom wall and/or the interior door wall or any other wall to which the primary refrigerant conduit is not connected. Preferably each different wall to which a thermosiphon of the invention is thermally connected will have its own separate auxiliary thermosiphon with its own thermal bridge.

The auxiliary refrigerant conduit 26 extends upward from the auxiliary evaporation segment 28 to an auxiliary condensation segment 30 of the auxiliary refrigerant conduit 26. The auxiliary condensation segment 30 is positioned at a higher elevation than the auxiliary evaporation segment 28. Although the ends 32 of the auxiliary refrigerant conduit 26 could be connected together to form a closed loop thermosiphon, preferably the ends 32 are more simply just sealed off after the auxiliary refrigerant conduit 26 is evacuated and a refrigerant charge is introduced.

The auxiliary refrigerant conduit 26 is connected through a thermal bridge 34 to the primary refrigerant conduit 18. The thermal bridge 34 is interposed in intimate physical contact with exterior surfaces of both the auxiliary condensation segment 30 and a portion of the primary evaporation segment 36 of the primary refrigerant conduit 18. The thermal bridge 34 forms a thermally conductive connection that transfers heat from the auxiliary thermosiphon to the primary refrigerant conduit 18 of the primary cooling apparatus. More specifically, the thermal bridge 34 transfers heat by conduction from the auxiliary condensation segment 30 through the thermal bridge 34 to the primary evaporation segment 36. In other words, evaporation in the primary refrigerant conduit 18 cools and condenses refrigerant in the auxiliary refrigerant conduit 26 and transports heat that is accepted from the auxiliary refrigerant to a primary condensation segment at or in the primary cooler 22.

Except for the physical connection through the thermal bridge, the auxiliary thermosiphon formed by the auxiliary refrigerant conduit 26 and the auxiliary refrigerant that it contains are entirely independent from the primary refrigerant conduit 18 and the primary refrigerant that it contains. There is no fluid connection between the passage through the auxiliary refrigerant conduit 26 and the passage through the primary refrigerant conduit 18. The primary refrigerant is isolated from the auxiliary refrigerant in the auxiliary thermosiphon. In fact different refrigerants could be used in each, for example refrigerants with different equilibrium temperatures.

A similar thermosiphon can also be similarly thermally connected to other interior walls, such as to an interior bottom wall of the freezer cabinet 10. Each auxiliary thermosiphon would preferably have its own thermal bridge which can be connected to the primary refrigerant conduit 18 anywhere along an evaporation segment of the primary refrigerant conduit 18. However, in order for an auxiliary conduit to function as a thermosiphon, condensation of the auxiliary refrigerant must occur at a higher elevation than evaporation of the auxiliary refrigerant so that the condensed refrigerant can flow downhill to the auxiliary evaporation segment and the evaporated refrigerant can flow uphill to the auxiliary condensation segment. Therefore, the condensation segment of each auxiliary thermosiphon must be at a higher elevation than the part of the primary evaporation segment to which the auxiliary condensation segment is connected by the thermal bridge. For that reason, it is preferred that the auxiliary condensation segment 30 be the top ends of the auxiliary refrigerant conduit 18. However, the auxiliary refrigerant conduit 18 could extend even higher but such an extension would be undesirable non-functional excess.

The structure of the preferred thermal bridge 34 is best seen in FIGS. 3 through 11. The thermal bridge 34 has a central thermal conductor 38 preferably constructed of an aluminum extrusion. Formed longitudinally along the central thermal conductor 38 are at least one and preferably two heat accepting grooves 40. Each heat accepting groove 40 has a cross sectional configuration that mates with at least a portion of the exterior cross sectional configuration of the auxiliary condensation segment 30 of the auxiliary refrigerant conduit 26. Also formed longitudinally along the central thermal conductor 38 are at least one and preferably two heat rejecting grooves 42. Each heat rejecting groove 42 has a cross sectional configuration that mates with at least a portion of the exterior cross sectional configuration of the primary evaporation segment 36 of the primary refrigerant conduit 18. The mating surfaces improve the physical contact and therefore the heat conduction between the respective refrigerant conduits 18, 26 and the central thermal conductor 38. Preferably the longitudinal grooves 40 and 42 are parallel and on diametrically opposite sides of the central thermal conductor 38 and alternate around the circumference between heat accepting grooves and heat rejecting grooves.

The central thermal conductor 38 and the refrigerant conduits 18, 26 are assembled with the auxiliary condensation segments 30 lying along the heat accepting grooves 40 and a portion of the primary evaporation segment 36 lying along the heat rejecting grooves 42. At least one and preferably multiple straps 44 surround and are pulled in tension so they tightly clamp together the assembled refrigerant conduits 18, 26 and central thermal conductor 38. The straps 44 do not need to be thermally conducting but it is desirable that they are. The straps force the refrigerant conduits 18, 26 into highly thermally conductive contact with the central thermal conductor 38. For example high tensile metal strapping of the type also known as pallet packaging strapping can be pulled around the assembly, tightened with a tensioner and then held in tension by a conventional sealer. The strap may also be attached to the top interior wall 24 to provide mechanical stability.

The cost savings resulting from use of the auxiliary thermosiphon of the invention exists because the auxiliary thermosiphon can be folded or bent and otherwise fabricated separately and apart from fabrication and installation of the primary refrigerant conduit and the primary cooler. After installation of the primary refrigerant conduit, the previously fabricated auxiliary thermosiphon is installed by simple manual mechanical manipulations to install the mounting brackets and the thermal bridge.

In a thermosiphon heat flows from a low place to a high place. Not only must the auxiliary condensation segment 30 at the thermal bridge be higher than the auxiliary evaporation segment 28 but also the auxiliary evaporation segment 28 must slope gradually down from the thermal bridge in a manner that avoids low spots or traps. Therefore, mounting brackets 46 are distributed at intervals along the auxiliary evaporation segment 28 in thermal connection between the auxiliary evaporation segment 28 and the top inner wall 24. The mounting brackets 46 have graduated and spatially varying heights and are arranged so that from the thermal bridge 34 the thermosiphon always has a progressively downward flowing trajectory for liquid refrigerant that is condensed at the thermal bridge 34. The mounting brackets 46 are arranged in a configuration so they support the auxiliary evaporation segment in an orientation that is inclined to a horizontal plane and continuously rising from its lowest elevation upwardly to the thermal bridge. This arrangement provides a gentle slope so the condensed liquid refrigerant can run downhill with no traps to prevent vapor from rising uphill to the thermal bridge. The auxiliary evaporation segment 28 and its connected mounting brackets 46 can be assembled and retained against the inner cabinet wall 24 using aluminum or other thermally conductive adhesive tape, a thermal paste, a thermal adhesive or combinations of them.

The above-described thermal bridge is only one of many possible configurations for a thermal bridge that would function with the invention. Its advantage is the ease, simplicity and relative safety with which it can be installed combined with its high thermal conductivity. However, there are examples of other thermal bridges. The thermal bridge can be formed by soldering, brazing or welding the respective refrigerant conduits together preferably in a small bundle. However that configuration was found to be inconvenient because of the difficulty of supporting the refrigerant conduits in position for the bonding operation and the danger of the damaging nearby structures by the required heat source such as a torch. They could be bonded together with an adhesive compound if an adhesive with sufficient thermal conductivity were used. Of course there are also other mechanical structures that could be used.

Preferably the auxiliary refrigerant conduit is charged to a pressure that locates the vapor-liquid equilibrium temperature of the particular refrigerant at a selected operating temperature of the freezer. Because the auxiliary refrigerant conduit of the auxiliary thermosiphon and its contained refrigerant are entirely separate and independent of the primary refrigerant conduit and its refrigerant, the auxiliary refrigerant can be a different refrigerant than the primary refrigerant. Additionally, the auxiliary refrigerant can be charged in the auxiliary thermosiphon to a pressure that locates the vapor-liquid equilibrium temperature of the auxiliary refrigerant at a different temperature than the vapor equilibrium temperature of the primary refrigerant.

During operation, the primary cooling apparatus provides a cold sink for the auxiliary thermosiphon's auxiliary condensation segment 30 through the thermal bridge 34. The auxiliary thermosiphon's auxiliary evaporation segment 28 that is attached to the top wall of the inner liner receives a downward flow of liquid refrigerant that was condensed at the auxiliary thermosiphon's auxiliary condensation segment 30 connected to the thermal bridge 34. The downward slope of the auxiliary thermosiphon needs to be only a few degrees in order to encourage the liquid flow to all parts of the auxiliary evaporator section. Because the refrigerant is near or at two-phase equilibrium, the auxiliary thermosiphon is essentially isothermal and provides a means to remove heat from (actively cool) the top part of the inner liner. In so doing, the temperature distribution within the freezer is favorably reduced. In practical tests, the auxiliary thermosiphon provided a reduction of the temperature spatial distribution of about 30%.

REFERENCE NUMBER LIST

10 ULT freezer cabinet
12 cabinet door
14 cabinet door gasket
16 cabinet top compartment
18 primary refrigerant conduit
20 cabinet vertical side walls
22 primary cooler
24 top inner cabinet wall
26 auxiliary refrigerant conduit
28 auxiliary evaporation segment
30 auxiliary condensation segment
32 ends of auxiliary refrigerant conduit
34 thermal bridge
36 primary evaporation segment
38 central thermal conductor of thermal bridge
40 heat accepting grooves of thermal bridge
42 heat rejecting grooves of thermal bridge
44 straps around thermal bridge
46 mounting brackets for auxiliary refrigerant conduit This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A freezer having a freezer cabinet with interior walls surrounding a cooling space and a primary cooling apparatus that includes a primary cooler and a primary refrigerant conduit containing a primary refrigerant, the primary refrigerant conduit having a primary condensation segment at the primary cooler and a primary evaporation segment, some of the primary evaporation segment being in thermally conductive connection to at least some of the interior walls for transporting heat from the interior walls to the primary cooler, the freezer further comprising:

(a) an auxiliary thermosiphon that includes an auxiliary refrigerant conduit having an auxiliary evaporation segment in thermally conductive connection to an interior wall of the freezer cabinet, the auxiliary thermosiphon containing an auxiliary refrigerant conduit also extending upward to an auxiliary condensation segment at an elevation above the auxiliary evaporation segment; and (b) a thermal bridge in thermal physical contact with the auxiliary condensation segment an in physical thermal contact with a portion of the primary evaporation segment for transporting heat through the thermal bridge from the auxiliary thermosiphon to the primary refrigerant conduit, the thermal bridge comprising:

(i) a central thermal conductor having at least one heat accepting groove, each heat accepting groove having a cross sectional configuration that mates with at least a portion of the exterior cross sectional configuration of the auxiliary condensation segment of the auxiliary refrigerant conduit and also having at least one heat rejection groove, each heat rejecting groove having a cross sectional configuration that mates with at least a portion of the exterior cross sectional configuration of the primary evaporation segment of the primary refrigerant conduit;

(ii) the central thermal conductor and the refrigerant conduits being assembled with at least a portion of the auxiliary condensation segment lying along the heat accepting groove and at least a portion of the primary evaporation segment lying along the heat rejecting groove; and (iii) a strap in tension surrounding and clamping together the assembled refrigerant conduits and central thermal conductor;

wherein during operation condensed liquid refrigerant flows downward from the auxiliary condensation segment to the auxiliary evaporation segment and vaporized refrigerant flows upward from the auxiliary evaporation segment to the auxiliary condensation segment, both flows occurring simultaneously in the same auxiliary refrigerant conduit.

2. A freezer in accordance with claim 1 wherein the auxiliary thermosiphon conduit has closed opposite ends that form the auxiliary condensation segment, wherein the central thermal conductor has a second said heat accepting groove and the closed opposite ends are assembled in the heat accepting grooves, wherein the central thermal conductor has a second said heat rejecting groove and each of the heat rejecting grooves contains a portion of the primary evaporation segment of the primary refrigerant conduit and wherein the assembled refrigerant conduits are surrounded and clamped together by multiples of said strap.

3. A freezer in accordance with claim 1 wherein said interior walls to which said primary refrigerant conduit is in thermally conductive connection are sidewalls of the freezer and the auxiliary evaporation segment of the auxiliary thermosiphon is in thermally conductive connection to a second interior wall that is not in thermal connection to the primary refrigerant conduit and the second interior wall is a top interior wall of the freezer cabinet.

4. A freezer in accordance with claim 1 wherein said interior walls to which said primary refrigerant conduit is in thermally conductive connection are sidewalls of the freezer and the auxiliary evaporation segment of the auxiliary thermosiphon is in thermally conductive connection to a second interior wall that is not in thermal connection to the primary refrigerant conduit and the second interior wall is a bottom interior wall of the freezer cabinet.

5. A freezer in accordance with claim 1 wherein said interior walls to which said primary refrigerant conduit is in thermally conductive connection are sidewalls of the freezer and the auxiliary evaporation segment of the auxiliary thermosiphon is in thermally conductive connection to a second interior wall that is not in thermal connection to the primary refrigerant conduit and the second interior wall is a door interior wall of the freezer cabinet.

6. A freezer in accordance with claim 1 wherein the auxiliary evaporation segment of the auxiliary thermosiphon is mounted in thermally conductive connection to an interior wall by thermally conductive mounting brackets attached to the auxiliary evaporation segment and attached to the interior wall, the mounting brackets having spatially varying heights and are arranged and distributed on the interior wall in a configuration supporting the auxiliary evaporation segment inclined to a horizontal plane and continuously rising from its lowest elevation upwardly to the thermal bridge.

7. A freezer in accordance with claim 1 wherein the auxiliary refrigerant conduit is charged to a pressure that locates the vapor-liquid equilibrium temperature of the auxiliary refrigerant at a selected operating temperature of the freezer.

* * * * *